US006899260B2

(12) United States Patent
Sun

(10) Patent No.: US 6,899,260 B2
(45) Date of Patent: May 31, 2005

(54) NAILING GUN

(75) Inventor: Pei-Chang Sun, Taichung (TW)

(73) Assignee: An Puu Hsin Co., LTD, Taichung (TW)

( * ) Notice: Subject to any disclaimer, the term of this patent is extended or adjusted under 35 U.S.C. 154(b) by 0 days.

(21) Appl. No.: 10/636,537

(22) Filed: Aug. 8, 2003

(65) Prior Publication Data

US 2005/0006428 A1 Jan. 13, 2005

(30) Foreign Application Priority Data

Jul. 7, 2003 (CN) ..... 03272748 U

(51) Int. Cl.[7] ..... B25C 1/06; F16H 21/16
(52) U.S. Cl. ..... 227/132; 74/49
(58) Field of Search ..... 74/25, 44, 49; 227/132, 129, 131, 147, 127; 173/55, 53

(56) References Cited

U.S. PATENT DOCUMENTS 4,530,454 A * 7/1985 Gloor et al. ..... 227/129
4,583,600 A * 4/1986 Smith, III ..... 173/124
4,724,992 A * 2/1988 Ohmori ..... 227/146
4,811,885 A * 3/1989 Lai ..... 227/131
5,118,023 A * 6/1992 Fushiya et al. ..... 227/8
5,605,268 A * 2/1997 Hayashi et al. ..... 227/8
5,720,423 A * 2/1998 Kondo et al. ..... 227/130

* cited by examiner

*Primary Examiner*—Rinaldi I. Rada
*Assistant Examiner*—Paul Durand

(57) ABSTRACT

The nailing gun uses a motor as a power drive to rotate a drive gear wheel and a driven gear wheel, causing the drive gear wheel and the driven gear wheel to alternatively move a slider from a nailing position to a standby position, for enabling a nail driving tip, which is fastened to the slider, to be moved with the slider from the standby position to the ailing position by spring member, which is compressed to preserve energy when the slider moved from the nailing position to the standby position.

6 Claims, 5 Drawing Sheets

NAILING GUN

BACKGROUND OF THE INVENTION

1. Field of the Invention

The present invention relates generally to a rechargeable nailing gun and, more particularly, to such a rechargeable nailing gun, which increases the impact stroke without increasing the dimension of the housing.

2. Description of the Related Art

The nail striking action of a conventional rechargeable nailing gun is achieved by starting a motor, causing the output shaft of the motor to rotate a transmission gear to move a slider. The slider has a protruding block. During rotary motion of the transmission gear, a protruding block of the transmission gear is forced into contact with the protruding block of the slider to push the slider to a position far from the muzzle of the barrel of the nailing gun, and at the same time a spring member is compressed by the slider. When the protruding block of the transmission gear moved over the protruding block of the slider during rotary motion of the transmission gear, an induction switch is triggered to turn off the motor, and the spring member returns to its former shape and to push the slider toward the muzzle of the barrel, causing the driving tip which is fastened to the front side of the slider to drive the nail into the workpiece.

This design of nailing gun is still not satisfactory in function. Because the maximum stroke of the slider is approximately equal to the arc of a small sector of the transmission gear, the short nail striking stroke of the slider does not provide a satisfactory nailing effect. Increasing the diameter of the transmission gear relatively increases the moving distance of the protruding block of the transmission gear during each nailing cycle, however this arrangement also relatively increases the size of the nailing gun, resulting in an inconvenient use of the nailing gun.

Therefore, it is desirable to provide a nailing gun that eliminates the aforesaid drawback.

SUMMARY OF THE INVENTION

The present invention has been accomplished under the circumstances in view. It is the main object of the present invention to provide a nailing gun, which increases the impact stroke of the nailing mechanism.

It is another object of the present invention to provide a nailing gun, which has a simple and compact structure.

To achieve these objects of the present invention, the nailing gun comprises a housing having a receiving chamber and an elongated work chamber; a nail magazine fastened to the housing; a gun barrel fixedly connected to a front end of the nail magazine corresponding to the work chamber; a transmission mechanism mounted in the receiving chamber inside the housing and having an output shaft; a drive gear wheel fixedly mounted on the output shaft for synchronous rotation and having a first driving element; a driven gear wheel rotatably meshed with the drive gear wheel and having a second driving element; and a nail driving unit mounted in the work chamber inside the housing and having a nail driving tip movable between the gun barrel and the work chamber, a slider movable between a first position and a third position through a second position in between the first position and the third position inside the work chamber, the slider having a first stop means for pushing by the first driving element to move the slider from the first position to the second position during rotary motion of the drive gear wheel, a second stop means for pushing by the second driving element to move the slider from the second position to the third position during rotary motion of the driven gear wheel, and a front side fixedly fastened to said nail driving tip, and push means adapted to push the slider from the third position to the first position.

DETAILED DESCRIPTION OF THE INVENTION

Figure 1:
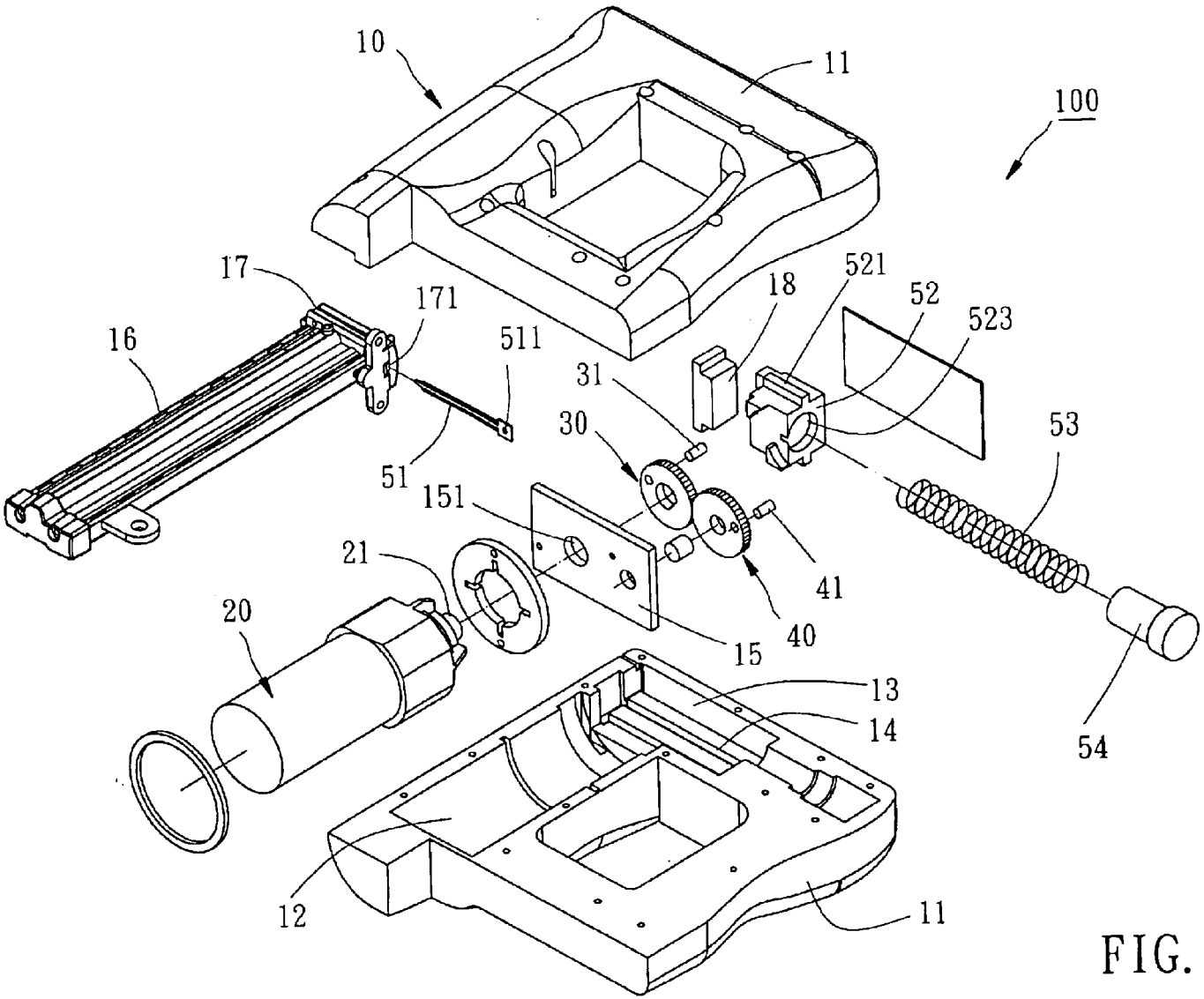
FIG. 1 is an exploded view of a nailing gun according to a preferred embodiment of the present invention.
Figure 2:
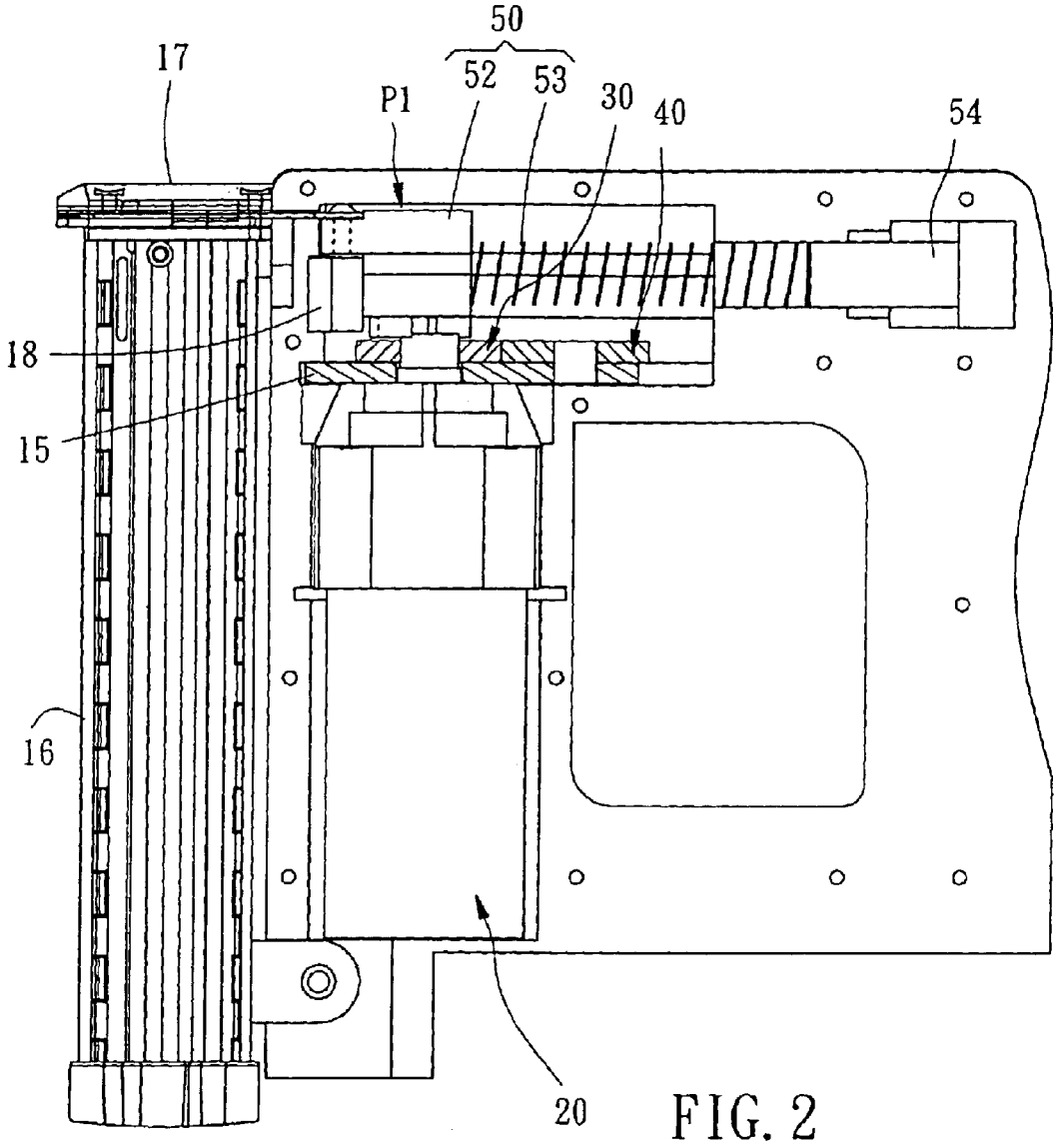
FIG. 2 is a schematic assembly view of the present invention, showing the status of the slider in the first position.

Referring to FIGS. 1 and 2, a nailing gun 100 is shown comprised of:

a housing 10 formed of two symmetrical half shells 11, the housing 10 having a receiving chamber 12, an elongated work chamber 13 in communication with the receiving chamber 12, two longitudinal sliding grooves 14 arranged in parallel in the work chamber 13, a locating plate 15 mounted in the work chamber 13, the locating plate 15 having a through hole 151;

a nail magazine 16 fastened to the outside wall of the housing 10;

a gun barrel 17 fixedly connected to the front end of the nail magazine 16 corresponding to the outer end of the work chamber 13, the gun barrel 17 defining a nail slot 171;

a buffer block 18 located on one end of the work chamber 13 of the housing 10 near the gun barrel 17;

a transmission mechanism formed of a motor 20 mounted in the receiving chamber 12 inside the housing 10, the motor 20 having an output shaft 21 of non-circular cross-section inserted through the through hole 151 of the locating plate 15 into the inside of the work chamber 13;

a drive gear wheel 30 fixedly mounted on the free end of the output shaft 21 of the motor 20 for synchronous rotation, the drive gear wheel 30 having a rod member 31 fixedly located on the front side near the periphery, which rod member 31 forming a first driving member;

a driven gear wheel 40 fastened rotatably with the locating plate 15 and meshed with the drive gear wheel 30, the driven gear wheel 40 having a rod member 41 fixedly located on the front side near the periphery, which rod member 41 forming a second driving member; and a nail driving unit 50.

The nail driving unit 50 is comprised of a nail driving tip 51, a slider 52, and a biasing member, for example, a spring 53.

The nail driving tip 51 is movable between the nail slot 171 of the gun barrel 17 and the work chamber 13, having a mounting hole 511 in one end. The slider 52 is a block member having two longitudinal rails 521 symmetrically located on the top and bottom sides and respectively coupled to the sliding grooves 14 in the work chamber 13 inside the housing 10 to guide linear movement of the slider 52 along the sliding grooves 14, a front pin 522 fastened to the mounting hole 511 of the nail driving tip 51 (see also FIG. 3), a recessed hole 523 in the rear side, and first and second stop means, namely, the upper stop block 524 and the lower stop block 525 in an upper part and a lower part of one side facing the locating plate 15. Further, there is an elevational difference H between the upper stop block 524 and the lower stop block 525.

The spring 53 has one end positioned in the recessed hole 523 of the slider 52 and the other end inserted into a fixed cap 54 at the rear side of the work chamber 13.

After structural description of the nailing gun 100, the operation of the nailing gun 100 is outlined hereinafter.

Figure 3:
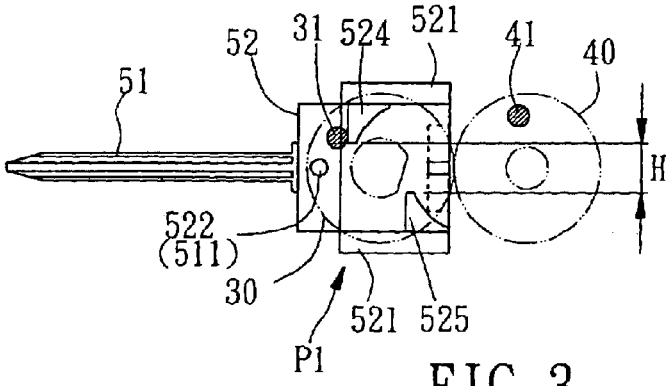
FIG. 3 is a schematic view illustrating the relationship between the drive gear wheel and the slider corresponding to the position shown in FIG. 2.

FIGS. 2 and 3 show the status of the slider 52 in a first position P1. At this time, the rod member 31 of the drive gear wheel 30 is stopped at the upper stop block 524 of the slider 52, and the spring 53 is in the extended status.

Figure 4:
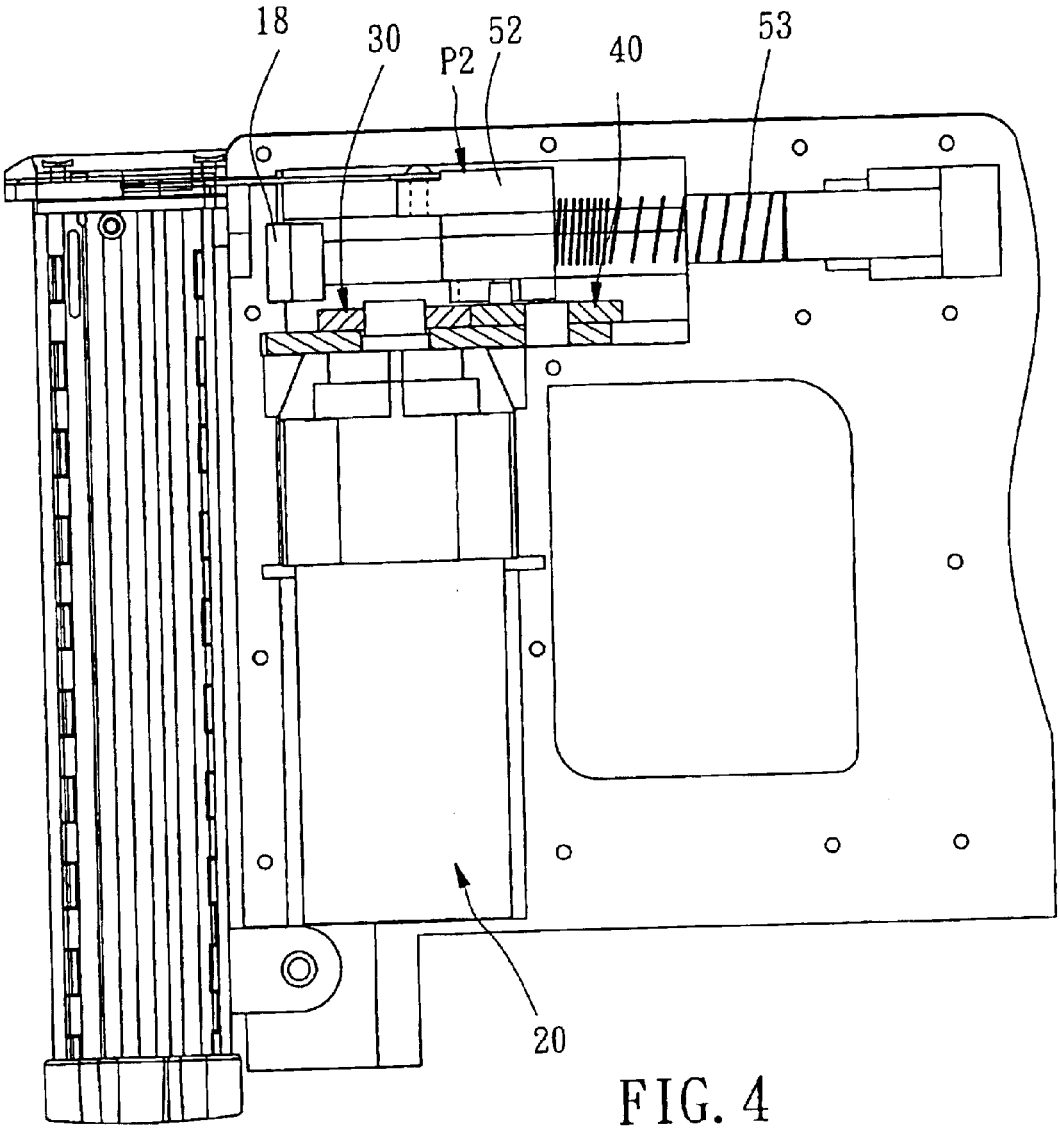
FIG. 4 is similar to FIG. 2 but showing the slider in the second position.
Figure 5:
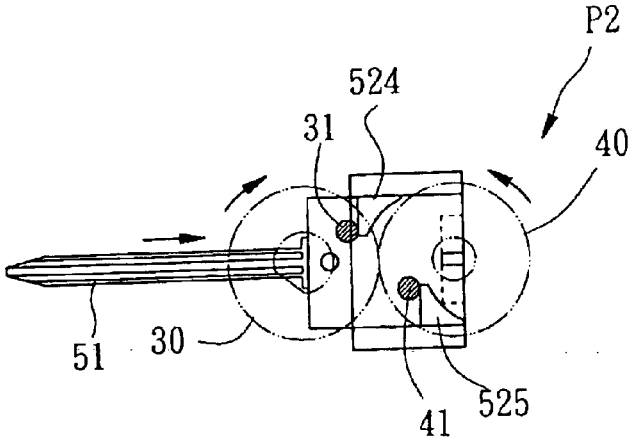
FIG. 5 is a schematic view illustrating the relationship between the drive gear wheel and the slider corresponding to the position shown in FIG. 4.
Figure 6:
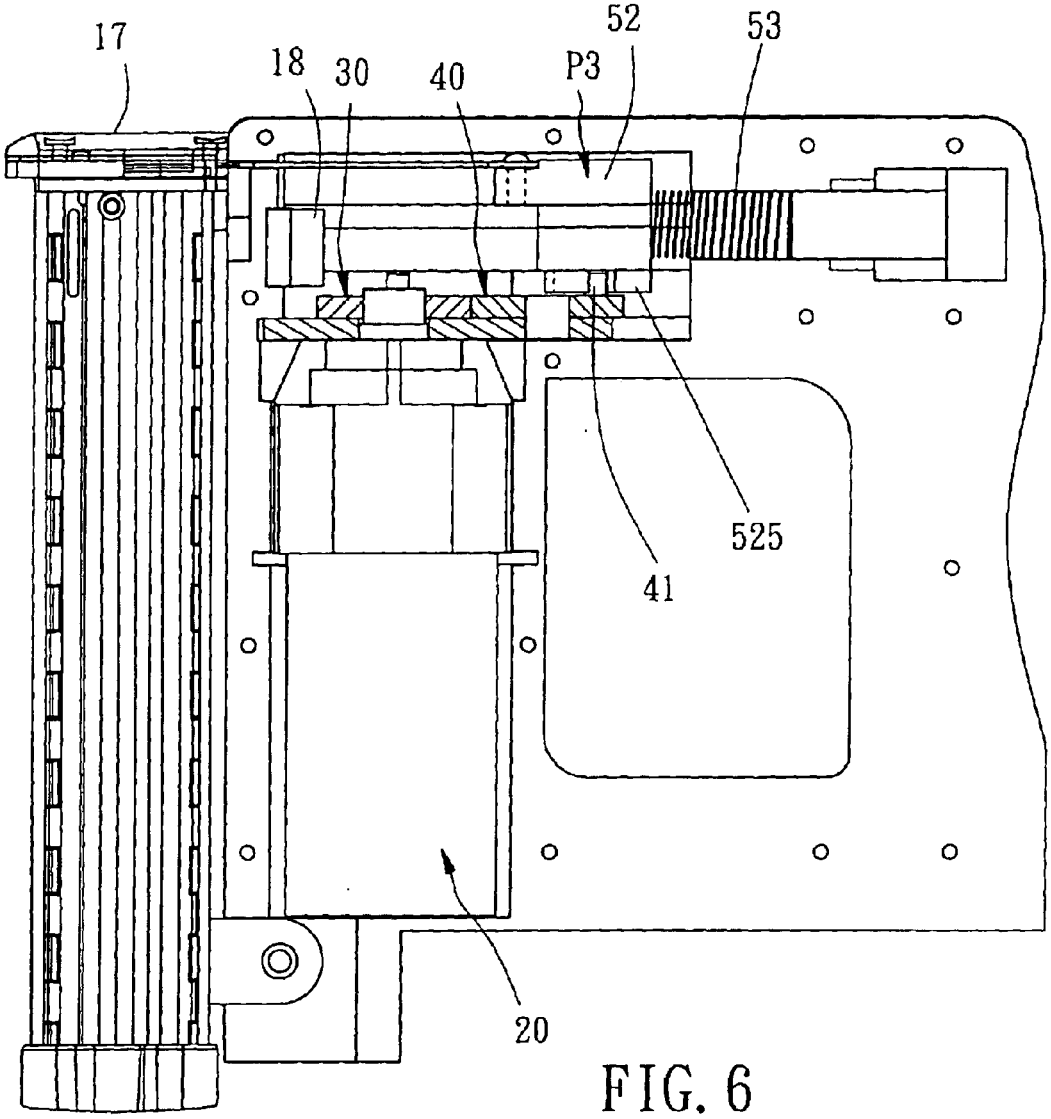
FIG. 6 is similar to FIG. 2 but showing the slider in the third position.
Figure 7:
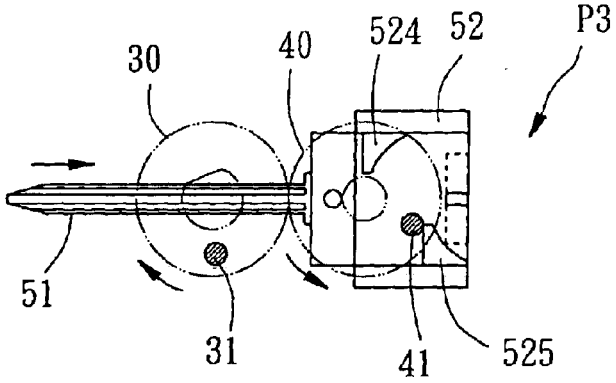
FIG. 7 is a schematic view illustrating the relationship between the drive gear wheel and the slider corresponding to the position shown in FIG. 6.
Figure 8:
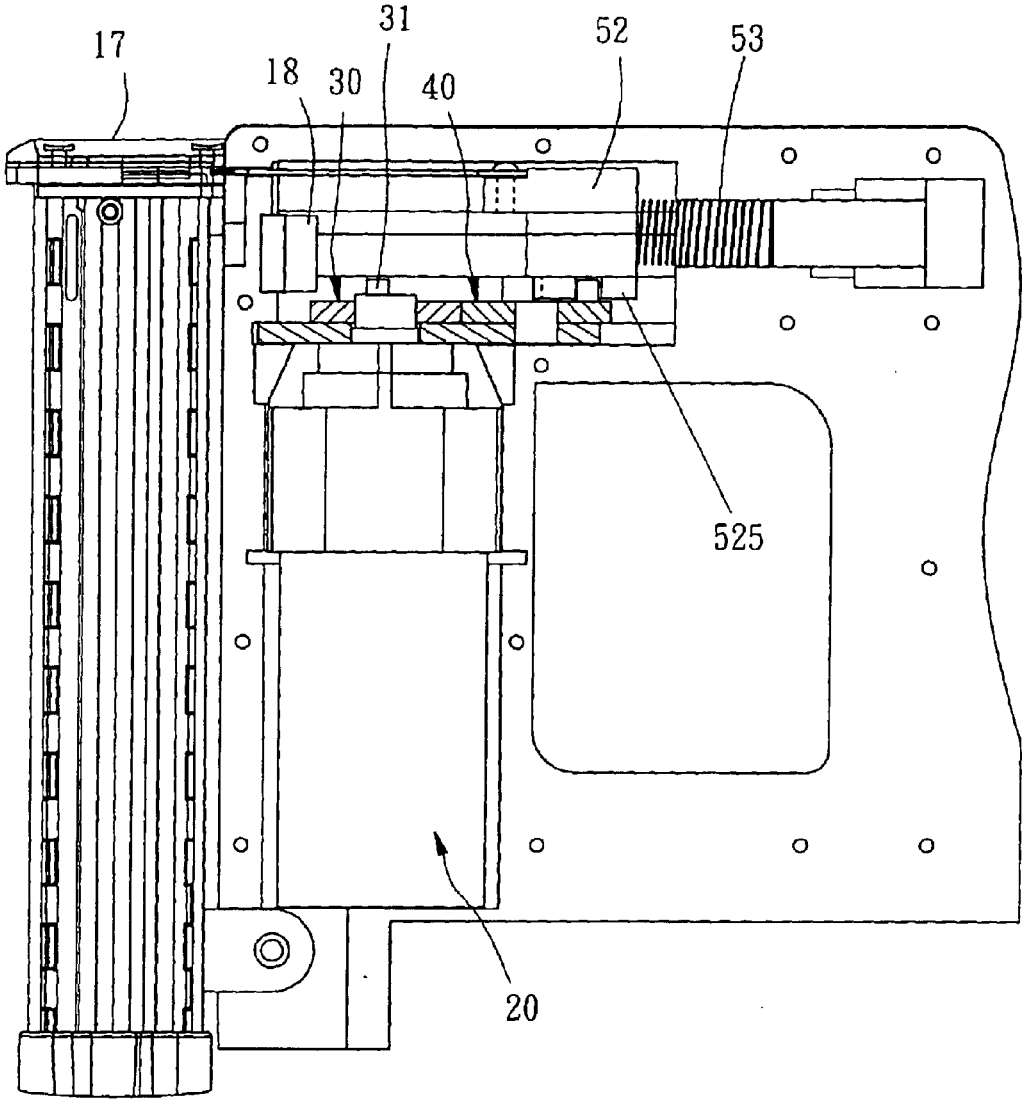
FIG. 8 is similar to FIG. 2 but showing the slider to be moved toward the gun barrel.
Figure 9:
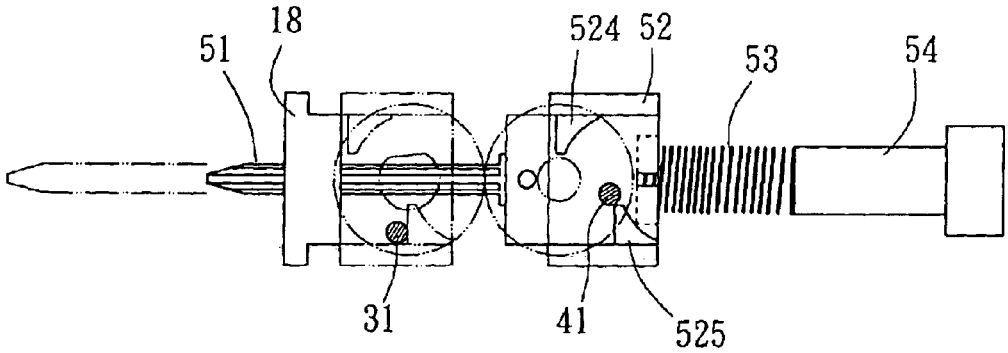
FIG. 9 is a schematic view illustrating the relationship between the drive gear wheel and the slider corresponding to the position shown in FIG. 8.

When continuously rotating the motor 20 to move the drive gear wheel 30 and the driven gear wheel 40, the rod member 31 of the drive gear wheel 30 forces the upper stop block 524 to move the slider 52 from the first position P1 to a second position P2 as shown in FIGS. 4 and 5. At the moment the slider 52 reached the second position P2, the nail driving tip 51 moved backwards relative to the buffer block 18, and the rod member 41 of the driven gear wheel 40 touches the lower stop block 525. Following continuous rotation of the driven gear wheel 40, the rod member 31 of the drive gear wheel 30 is moved away from the upper stop block 524, and the rod member 41 of the driven gear wheel 40 pushes the slider 52 from the second position P2 to a third position P3, as shown in FIGS. 6 and 7. At this time, the slider 52 is spaced from the gun barrel 17 at a long distance, i.e., a long impact stroke is produced, and the spring 53 is compressed by the slider 52 to preserve energy. Please refer also to FIGS. 8 and 9, when the slider 52 reached the third position P3 during continuous rotary motion of the drive gear wheel 30 and the driven gear wheel 40, the rod member 41 is spaced from the lower stop block 525 at a distance and suspended in the area within the elevational difference H, and the spring 53 is released to impart a thrust force to the slider 52, causing the nail driving tip 51 to move with the slider 52 toward the gun barrel 17 rapidly. When the front side of the slider 52 touched the buffer block 18, one nailing cycle is done.

As indicated above, the combined transmission of the drive gear wheel 30 and the driven gear wheel 40 double the impact stroke of the nail driving mechanism, enhancing the nail driving action of the nailing gun without increasing the dimension of the housing 10.

What is claimed is:

1. A nailing gun comprising:

a housing having a receiving chamber and an elongated work chamber;

a nail magazine fastened to said housing;

a gun barrel fixedly connected to a front end of said nail magazine corresponding to said work chamber;

a transmission mechanism mounted in said receiving chamber and having an output shaft;

a drive gear wheel fixedly mounted on said output shaft for synchronous rotation and having a first driving element;

a driven gear wheel rotatably meshed with said drive gear wheel and having a second driving element; and a nail driving unit mounted in said work chamber and having a nail driving tip movable between said gun barrel and said work chamber, a slider movable between a first position, a second position and a third position through the second position in between said first position and said third position inside said work chamber, said slider having a first stop means for pushing by said first driving element to move said slider from said first position to said second position during rotary motion of said drive gear wheel, a second stop means for pushing by said second driving element to move said slider from said second position to said third position during rotary motion of said driven gear wheel, and a front side thereof fixedly fastened to said nail driving tip, and biasing means for thrusting said slider from said third position to said first position.

2. The nailing gun as claimed in claim 1, further comprising a buffer block mounted in said work chamber inside said housing near said gun barrel for buffering said slider when said slider is moved from said third position to said first position.

3. The nailing gun as claimed in claim 2, wherein said first driving element and said second driving element are respectively formed of a rod member respectively and perpendicularly located on a respective front side of said drive gear wheel and said driven gear wheel; the first stop means and second stop means of said slider are stop blocks respectively formed in a upper part and a lower part of one side of said slider.

4. The nailing gun as claimed in claim 3, wherein said housing comprises two longitudinal sliding grooves arranged in parallel for guiding linear movement of said slider; said slider comprises two longitudinal rails respectively coupled to said longitudinal sliding grooves to guide linear movement of said slider along said longitudinal sliding grooves.

5. The nailing gun as claimed in claim 4, wherein said transmission mechanism comprises a motor mounted in said receiving chamber; said output shaft extends from said motor into said work chamber and connected to said drive gear wheel.

6. The nailing gun as claimed in claim 5, wherein said biasing means is a spring having a first end connected to a rear side of said slider and a second end connected to a part of said housing.

* * * * *